US008052858B2

(12) United States Patent
Hiraoka et al.

(10) Patent No.: US 8,052,858 B2
(45) Date of Patent: Nov. 8, 2011

(54) PRETREATMENT METHOD FOR ELECTROLESS PLATING MATERIAL AND METHOD FOR PRODUCING MEMBER HAVING PLATED COATING

(75) Inventors: Motoki Hiraoka, Toyota (JP); Takeshi Bessho, Toyota (JP); Sigeru Sibata, Okazaki (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 517 days.

(21) Appl. No.: 10/530,516

(22) PCT Filed: Oct. 9, 2003

(86) PCT No.: PCT/JP03/13012

§ 371 (c)(1),
(2), (4) Date: Oct. 5, 2005

(87) PCT Pub. No.: WO2004/033754

PCT Pub. Date: Apr. 22, 2004

(65) Prior Publication Data

US 2006/0108232 A1 May 25, 2006

(30) Foreign Application Priority Data

Oct. 10, 2002 (JP) ..... 2002-298067

(51) Int. Cl.

| | |
|---|---|
| ***B05D 3/02*** | (2006.01) |
| ***C25D 5/56*** | (2006.01) |
| ***C25D 5/34*** | (2006.01) |
| ***C23C 28/02*** | (2006.01) |
| ***C23C 18/18*** | (2006.01) |
| ***C23C 18/22*** | (2006.01) |
| ***C23C 18/26*** | (2006.01) |

(52) U.S. Cl. ..... 205/167; 427/553; 427/304; 427/305; 427/306; 427/443.1; 427/558; 427/444; 205/187

(58) Field of Classification Search ..... 427/553, 427/523, 531, 532, 554, 557, 558, 595, 596, 427/597, 299, 301, 304, 305, 306; 205/167
See application file for complete search history.

(56) References Cited

U.S. PATENT DOCUMENTS 4,437,999 A * 3/1984 Mayne ..... 210/748.11

(Continued)

FOREIGN PATENT DOCUMENTS

JP 55-145620 * 11/1980

(Continued)

OTHER PUBLICATIONS

Answers.com., definitions of hydrofluoric acid and hydrochloric acid, 2 pages, retrieved Apr. 4, 2011.*

(Continued)

*Primary Examiner* — Katherine A Bareford
(74) *Attorney, Agent, or Firm* — Finnegan, Henderson, Farabow, Garrett & Dunner, LLP

(57) ABSTRACT

A resin material is brought into contact with a first solution containing ozone, and at the same time, ultraviolet rays are irradiated. The activation due to the treatment with ozone water and the activation due to the treatment with ultraviolet rays are synergistically operated to enable the formation of a plated coating having excellent adhesive strength by a short treatment. In addition, even by a long treatment, the adhesive strength can be restrained from lowering. Consequently, a plated coating having excellent adhesion can be formed without roughening the surface of the resin material by a short pretreatment.

9 Claims, 2 Drawing Sheets

U.S. PATENT DOCUMENTS

| | | | | |
|---|---|---|---|---|
| 4,440,801 | A * | 4/1984 | Aviram et al. | 427/558 |
| 4,528,245 | A | 7/1985 | Jobbins | |
| 5,803,131 | A * | 9/1998 | Iwasa et al. | 138/137 |
| 6,992,000 | B2 * | 1/2006 | Honma et al. | 438/535 |

FOREIGN PATENT DOCUMENTS

| | | | |
|---|---|---|---|
| JP | 01-092377 | | 11/1989 |
| JP | 6-287784 | | 10/1994 |
| JP | 08-092752 | | 4/1996 |
| JP | 08-253869 | | 10/1996 |
| JP | 9-157417 | | 6/1997 |
| JP | 10-088361 | | 4/1998 |
| JP | 11-244360 | * | 9/1999 |
| JP | 2001-131759 | | 5/2001 |
| JP | 2002-023367 | | 1/2002 |
| JP | 2002-025971 | * | 1/2002 |
| JP | 2002-275638 | | 9/2002 |

OTHER PUBLICATIONS

Japanese Office Action dated Feb. 5, 2008.

Kenneth Mason Publications, Polyimide Surface Modification by Ozonlysis, Research Disclosure, No. 339, 1992, p. ABSTRNO33937 XP001156084 ISSN: 0374-4353, Abstract.

* cited by examiner

PRETREATMENT METHOD FOR ELECTROLESS PLATING MATERIAL AND METHOD FOR PRODUCING MEMBER HAVING PLATED COATING

TECHNICAL FIELD

The present invention relates to a pretreatment method for improving the adhesion of a plated coating formed by subjecting a surface of a resin material to an electroless plating, and a method for producing a member having such a plated coating.

BACKGROUND ART

The electroless plating has been known as the method for giving electric conductivity and metallic luster to a resin material. This electroless plating is the method of chemically reducing metal ions in a solution, and depositing a metal coating on a surface of a material, and with this method, a metal coating can be formed on an insulator such as resins, too, as is different from electroplating of depositing a metal coating by electrolysis with electric power. In addition, electroplating can be carried out on the resin material on which a metal coating has been formed with electroless plating, thereby enlarging the use of the resin material. For these reasons, the eletroless plating has been widely used as the method for giving metallic luster and/or electric conductivity to the resin material for use in various fields such as parts of motor vehicles, household electric appliances, etc.

The plated coating formed with electroless plating, however, has the problems that it takes a considerable time to form the coating, and the adhesion of the coating against the resin material is not sufficient. In order to solve these problems, there has been generally carried out the process of chemically etching the resin material to roughen the surface thereof before electroless plating.

Japanese unexamined patent publication No. Hei 1-092377, for example, discloses the method of previously treating a resin material with an ozone gas, and then electroless plating the treated resin material. In accordance with this publication, unsaturated bonds in the resin material are cut by the ozone gas to be changed to low molecules, and consequently, molecules having different chemical compositions coexist on a surface of the resin material, whereby the smoothness thereof is lost, and the surface is roughened. Accordingly, the coating formed with electroless plating tightly enter the roughened surface to prevent the coating from readily peeling off therefrom.

Furthermore, Japanese unexamined patent publication No. Hei 8-092752 discloses the method of previously roughening polyolefin as a resin material by etching, bringing the roughened polyolefin into contact with an ozone water, and then treating the roughened polyolefin with a solution containing a cationic surface active agent.

In the above-described related methods, the adhesion of the plated coatings is enhanced with a so-called anchor effect by roughening surfaces of the resin materials. With these methods, however, the surface smoothness of the resin material decreases. Accordingly, in order to obtain metallic luster giving good appearance to the resin material, the plated coating must be thick to cause the defect of an increment of the number of man hour.

In addition, in the method of roughening the surface of the resin material by etching, hazardous substances such as chromic acid, sulfuric acid, etc. must be used, and accordingly, there arise problems in the treatment of resultant liquid waste, etc. Furthermore, this method cannot solve the problem that the surface smoothness of the resin material decreases.

Under the above circumstances, Japanese unexamined patent publication No. Hei 10-088361 and Japanese unexamined patent publication No. Hei 8-253869 disclose the method of irradiating a resin material with ultraviolet rays, and treating the obtained resin material with electroless plating. By the ultraviolet irradiation, the surface of the resin material is activated, and active groups on the activated resin material chemically bond to active metal particles as a plating material, thereby forming a plated coating having excellent adhesion.

The method of irradiating ultraviolet rays, however, requires a large amount of energy for activating the surface of the resin material, and accordingly, there occurs the case where the resin material is degenerated with thermic rays from a light source.

Furthermore, it has been difficult to activate the resin material such as polypropylene (PP) or a polymer alloy containing elastomer and PP with only the method of treating with an ozone gas or the method of irradiating ultraviolet rays. In addition, it has been clarified that where the treating time is too short or too long, the adhesive strength of a plated coating lowers, but, the border of the treating time is unclear so that it is difficult to determine the treating time. And the treating time required for effecting a sufficient adhesive strength of the plated coating is generally long, and the productivity is low. Accordingly, it has been desired to shorten the treating time therefor.

The present invention has been made considering these problems of the related methods, and has an object of obtaining the method capable of forming a plated coating exhibiting excellent adhesion by a short pretreatment without roughening a surface of a resin material.

The pretreatment method for an electroless plating material in accordance with the present invention is characterized by an ozone solution-ultraviolet irradiation treating process of irradiating a resin material with ultraviolet rays in the state where the resin material is in contact with a first solution containing ozone being carried out.

It is preferable that an alkali treating process of bringing a second solution which contains an alkaline component into contact with the resin material treated with the ozone solution-ultraviolet irradiation treating process is further carried out. And it is preferable that at least one of an anionic surface active agent and a nonionic surface active agent is further included in the second solution. And it is preferable that the first solution contains a solvent composed of an organic or inorganic polar solvent.

In addition, the method for producing a member having a plated coating in accordance with the present invention is characterized by an ozone solution-ultraviolet irradiation treating process of irradiating a plating material with ultraviolet rays in the state where the resin material is in contact with a first solution containing ozone, and an electroless plating process of subjecting the resin material after the ozone solution-ultraviolet irradiation treating process to electroless plating being included.

It is preferable that an alkali treating process of bringing a second solution which contains an alkaline component into contact with a resin material is further included between the ozone solution-ultraviolet irradiation treating process and the electroless plating process. In addition, it is preferable that at least one of an anionic surface active agent and a nonionic surface active agent is further included in the second solution. And it is preferable that the first solution contains a solvent composed of an organic or inorganic polar solvent. Furthermore, it is preferable that an electroplating process of further subjecting the resin material after the electroless plating process to electroplating is included.

BEST MODE FOR CARRYING OUT THE INVENTION

Figure 1:
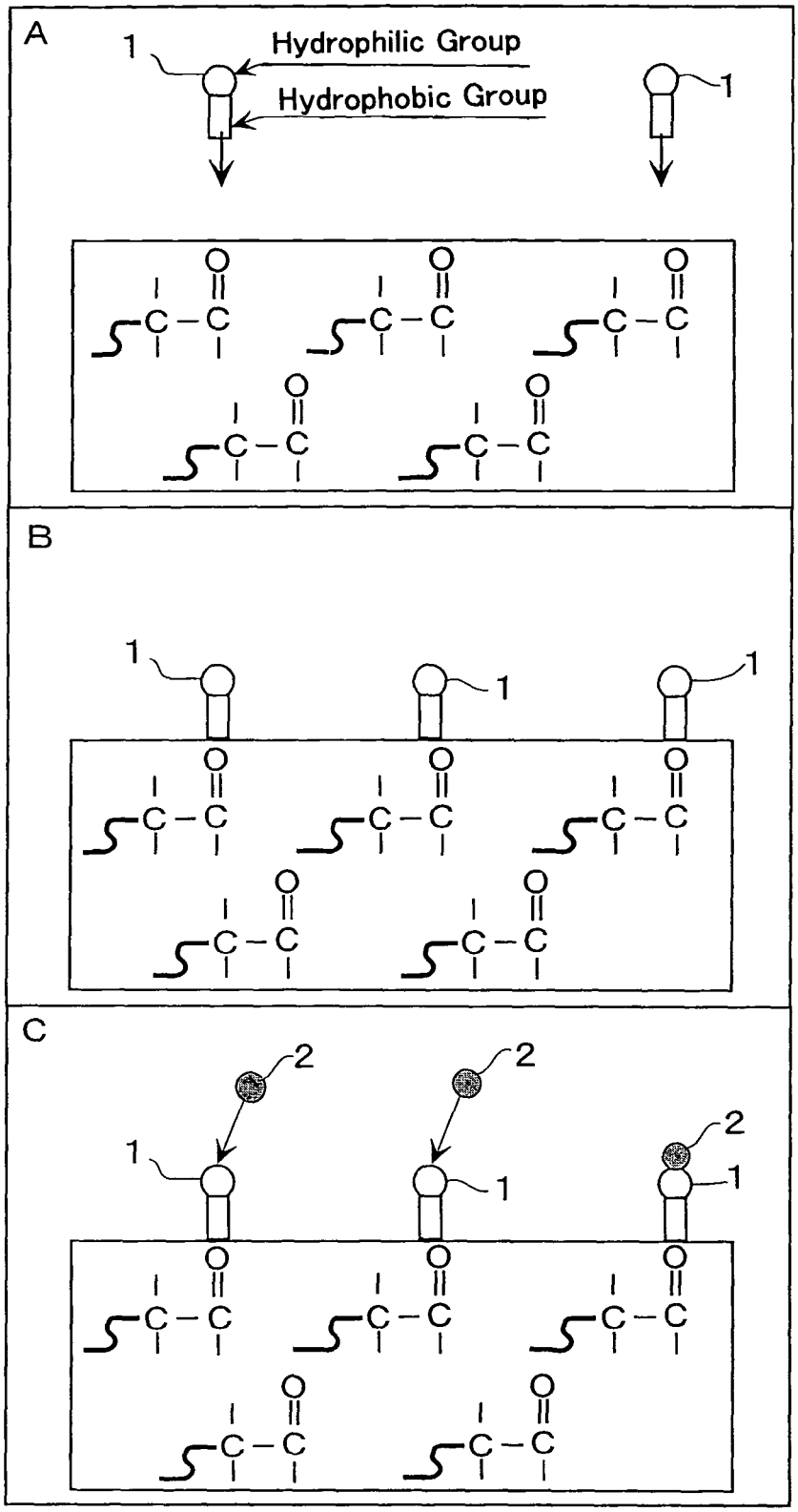
FIG. 1 is an explanation diagram showing presumed operations of the present invention.

In the present invention of the pretreatment method for an electroless plating material, an ozone solution-ultraviolet irradiation treating process of irradiating a resin material with ultraviolet rays in the state where the resin material is in contact with a first solution containing ozone is carried out. By irradiating the resin material with ultraviolet rays in the state where the resin material is in contact with the first solution which contains ozone, the operation of activating a surface of the resin material by ozone and oxygen radicals formed by the ultraviolet irradiation to the oxygen generated from the first solution, the operation of forming polar groups by linking the solvent in the first solution with the active groups on the activated surface of the resin material, and the operation of restraining thermal damage to be applied to the resin material by letting an excess heat given to the resin material due to the ultraviolet irradiation escape to the first solution, are synergistically achieved to extremely enhance the activity of the surface of the resin material even with a short treatment, thereby enabling the formation of a plated coating having excellent adhesion. In addition, in the case of even the resin material such as PP, a polymer alloy containing elastomer and PP, etc., a plated coating having excellent adhesion can be formed.

Thermoplastic resins such as ABS, AS, AAS, PS, EVA, PMMA, PBT, PET, PPS, PA, POM, PC, PP, PE, polymer alloys containing elastomer and PP, modified PPO, PTFE, ETFE, etc., or thermosetting resins such as phenol resin, epoxy resin, etc. can be used as the resin material. The configuration thereof is not limited specifically.

The concentration of ozone in the first solution greatly affects the activation of the surface of the resin material, when the concentration increases to about 10 ppm, the activation effect is observed, and when the concentration is 100 ppm or more, the activation effect drastically increases to enable a shorter treatment. And when the concentration is low, the deterioration of the resin material precedes the activation thereof so that a higher ozone concentration is preferable.

Normally, water is used as a solvent of the first solution, but it is preferable to use an organic or inorganic polar solvent as the solvent. By virtue of such solvent, the treating time can be further shortened. Examples of the organic polar solvent include alcohols such as methanol, ethanol or isopropyl alcohol, etc., N,N-dimethylformaldehyde, N,N-dimethylacetamide, dimethyl sulfoxide, N-methyl-pyrrolidon, hexamethylphosphoramide, organic acids such as formic acid, acetic acid, etc., or mixtures of these solvents with water and alcohol-based solvents. And examples of the inorganic polar solvent include inorganic acids such as nitric acid, hydrochloric acid, hydrofluoric acid, etc.

It is preferable that the ultraviolet rays to be irradiated have a wavelength of 310 nm or less, and the wavelength of 260 nm or less is more preferable, and the wavelength ranging from 150 to about 200 nm is further preferable. And it is preferable that the amount of ultraviolet irradiation is 50 mJ/cm$^2$ or more. A low pressure mercury lamp, a high-pressure mercury lamp, an excimer lazar, a barrier discharge lamp, a microwave nonelectrode discharge lamp, etc. can be used as a light source capable of irradiating such ultraviolet rays.

In order to bring the resin material into contact with the first solution containing ozone, the method of spraying the first solution on a surface of the resin material, method of immersing the resin material in the first solution, etc. is carried out. With the method of immersing the resin material in the first solution, ozone is difficult to be released from the first solution, as compared with the case the first solution is sprayed on the resin material, so that the immersing method is preferable. In order to irradiate ultraviolet rays, it is preferable to irradiate with the resin material immersed in the first solution containing ozone. With this method, deformation and deterioration of the resin material due to the heat from the ultraviolet light source can be restrained, and such a defect that the adhesion of the plated coating lowers where ultraviolet rays are irradiated for a long time can be prevented.

In order to irradiate ultraviolet rays on the resin material immersed in the first solution, the ultraviolet irradiation may be carried out with the ultraviolet light source being put inside the first solution, or may be carried out from the upper side of a liquid surface of the first solution. And by forming a container for the first solution of a material having ultraviolet-transmissibility, such as transparent quarz, the ultraviolet irradiation can be carried out from the outside of the container of the first solution.

Where the resin material is irradiated with ultraviolet rays after contacting the first solution, it is preferable to irradiate ultraviolet rays for a short time such as 1 minute or less. Where a long time has passed after contacting the first solution, it has become difficult to achieve the synergistic operations of the ozone and ultraviolet rays, and the adhesion of a plated coating may lower with a short irradiation treatment.

Basically, as the treating temperature in the ozone solution-ultraviolet irradiation treating process rises, the reaction rate increases, but as the treating temperature rises, the solubility of ozone in the first solution lowers, and in order to increase the concentration of ozone in the first solution to 100 PPM or more at a temperature higher than 40° C., the treating atmosphere must be pressurized to be more than an air pressure, and consequently, the device becomes large. Accordingly, where the device is not desired to become large, about room temperature is good enough for the treating temperature.

The contacting time of the first solution and the resin material in the ozone solution-ultraviolet irradiation treating process depends on the kind of resin of the resin material, but it is preferable to range from 4 to 20 minutes. In the case of less than 4 minutes, it becomes difficult to achieve the effect due to the ozone treatment even where the ozone concentration is 100 ppm, whereas in the case of greater than 20 minutes, the deterioration of the resin material occurs.

In addition, the irradiation time of ultraviolet rays in the ozone solution-ultraviolet irradiation treating process depends on the kind of resin of the resin material, but it is preferable to range from 4 to 15 minutes. In the case of less than 4 minutes, it becomes difficult to achieve the effect due to the ultraviolet irradiation, whereas in the case of greater than 15 minutes, the deterioration of the resin material may occur or the adhesive strength of the plated coating may lower due to heat.

In the pretreatment method for an electroless plating material in accordance with the present invention, it is preferable to further carry out the alkali treating process of bringing a second solution which contains an alkaline component into contact with the resin material after the ozone solution-ultraviolet irradiation treating process. The alkaline component has the function of dissolving the surface of the resin material on a molecular level, whereby a brittle layer is removed from a surface of the resin material and a larger amount of functional groups can be made to appear on the surface of the resin material. And consequently, the adhesion of a plated coating is further improved.

The alkaline component capable of dissolving the surface of the resin material on a molecular level to remove the brittle layer can be used, and sodium hydroxide, potassium hydroxide, lithium hydroxide, etc. can be used.

It is preferable that the second solution further contains at least one of an anionic surface active agent and a nonionic surface active agent.

It is considered that at least one of functional groups of C═O and C—OH exists on the surface of the resin material due to the ozone solution-ultraviolet irradiation treating process. Accordingly, it is considered that in the alkali treating process, as shown in FIG. 1(A), (B), a hydrophobic group of a surface active agent 1 is adsorbed on the above-described functional group appearing on the surface of the resin material. In addition, the surface active agent 1 is also adsorbed on a new functional group appearing due to the removal of the brittle layer by the alkaline material.

Then, in the electroless plating process, the resin material on which the surface active agent is adsorbed is brought into contact with a catalyst. It is considered that this results in, as shown in FIG. 1(C), a catalyst 2 being adsorbed on a hydrophilic group of the surface active agent 1, which has been adsorbed on the above-described functional group.

And it is considered that by subjecting the resin material on which a sufficient amount of catalyst is adsorbed, to the electroless plating, the surface active agent is released from the functional groups, and metal bonds to the C—O groups and/or C═O groups. Consequently, a plated coating which is excellent in adhesion can be formed.

The surface active agent of which hydrophobic groups are easily adsorbed on at least one of functional groups of C═O and C—OH is used, and at least one of an anionic surface active agent and a nonionic surface active agent is used. In the case of a cationic surface active agent and a neutral surface active agent, it becomes impossible to form a plated coating, or it becomes difficult to achieve the above-described effect. Examples of the anionic surface active agent include sodium lauryl sulfate, potassium lauryl sulfate, sodium stearyl sulfate, potassium stearyl sulfate, etc. And examples of the nonionic surface active agent include polyoxyethylene dodecyl ether, polyethylene glycol dodecyl ether, etc.

It is preferable to use a polar solvent as a solvent for the second solution containing the surface active agent and the alkaline component, and water can be used as a representative example of the polar solvent. Under certain circumstances, an alcohol-based solvent or a water-alcohol mixture solvent may be used. In addition, in order to bring the second solution into contact with the resin material after the ozone solution-ultraviolet irradiation treating process, the method of immersing the resin material in the second solution, the method of coating the surface of the resin material with the second solution, the method of spraying the second solution on the surface of the resin material, or other methods can be carried out.

It is preferable that the concentration of the surface active agent in the second solution is adjusted to range from 0.01 to 10 g/L. When the concentration of the surface active agent is less than 0.01 g/L, the adhesion of the plated coating lowers, and when the concentration of the surface active agent is greater than 10 g/L, the surface active agent keeps in contact with the surface of the resin material, and an excess surface active agent associates with each other to remains as impurities, whereby the adhesion of the plated coating lowers. In this case, the resin material may be cleaned with water after the pretreatment to remove the excess surface active agent.

In addition, it is preferable that the concentration of the alkaline component in the second solution is 12 or more (pH value). Even when the pH value is less than 12, the above-described effect can be achieved, but the amount of the above-described functional groups appearing on the surface of the resin material is small, whereby it takes a long time to form a plated coating having a predetermined thickness.

The contacting time of the second solution with the resin material is not limited specifically, but 1 minutes or more at room temperature is preferable. If the contacting time is too short, the amount of the surface active agent which is adsorbed on the functional groups may become short to lower the adhesion of the plated coating. However, if the contacting time is too long, even the layer on which at least one of the functional groups of C═O and C—OH appears is dissolved to make the electroless plating difficult. The contacting time of about 1 to 5 minutes is good enough. It is preferable that the treating temperature is as high as possible, and as the temperature rises, the contacting time can be made shorter, but the temperature ranging from room temperature to about 60° C. is good enough.

In the alkali treating process, the surface active agent may be adsorbed after treated with an aqueous solution containing only the alkaline component, but there may occur the case where a brittle layer is formed again until the surface active agent is adsorbed, and accordingly, it is preferable that the alkali treating process is carried out in the state that at least one of the anionic surface active agent and the nonionic surface active agent, and the alkaline component coexist with each other.

In addition, It is preferable to carry out the alkali treating process after the ozone solution-ultraviolet irradiation treating process, but under certain circumstances, the ozone solution-ultraviolet irradiation treating process and the alkali treating process can be carried out simultaneously. In this case, a mixture solution of the first solution and the second solution is prepared, a resin material is immersed in the prepared mixture solution, and ultraviolet rays are irradiated, or ultraviolet rays are irradiated while the prepared mixture solution is sprayed on a surface of the resin material, or after the prepared mixture solution is sprayed on a surface of the resin material. In this case, the reaction of ozone and ultraviolet rays on the surface of the resin material is a rate-determining step, so that the treating time is determined in accordance with the concentration of ozone in the mixture solution or the strength of the ultraviolet lays.

The process of removing the alkaline component may be carried out after the alkali treating process by cleaning a plated coating with water. It has been clarified that since the surface active agent is strongly adsorbed on the functional groups, the surface active agent is not removed by merely cleaning with water, and continuously adsorbed on the functional groups. Accordingly, the resin material which has been pretreated by the method in accordance with the present invention does not lose the effect thereof even after a considerable time has passed prior to the electroless plating process.

Catalysts which have been used in conventional electroless plating treatments, such as $Pd^{2+}$, can be used as the catalyst.

In order to adsorb the catalyst on the surface of the resin material, the solution in which catalyst ions are dissolved may be brought into contact with a surface of an adhered material, in a similar manner to that of the case of the contacting of the above-described second solution. And the conditions such as the contacting time, temperature, etc. may be the same as those in the conventional methods.

The conditions, the kind of the metal to be deposited, etc. in the electroless plating are not limited specifically. The electroless plating in accordance with the present invention can be carried out, similarly to the conventional electroless plating.

And, it is preferable to further carry out the electroplating process of subjecting the resin material after the electroless plating process, to the electroplating. With this method, metallic luster and electric conductivity can be given to the resin material. The appearance thereof is also improved drastically.

With the pretreatment method for the electroless plating material and a method for producing a member having a plated coating in accordance with the present invention, a plated coating having an excellent adhesive strength can be formed by a short treatment. In addition, even by a long treatment, the adhesive strength can be restrained from lowering, and accordingly the precision of the treating time can be lowered, thereby improving the work efficiency. In addition, the surface of the resin material is not required to roughen so that a plated coating having a high grade of metallic luster can be formed with a small thickness, and consequently, chromic acid or the like is not needed, thereby facilitating the waste disposal.

Embodiments

Hereinafter, the present invention will be explained concretely in accordance with several embodiments and comparative examples.

Embodiment 1

<Ozone Solution-Ultraviolet Irradiation Treating Process>

Figure 2:
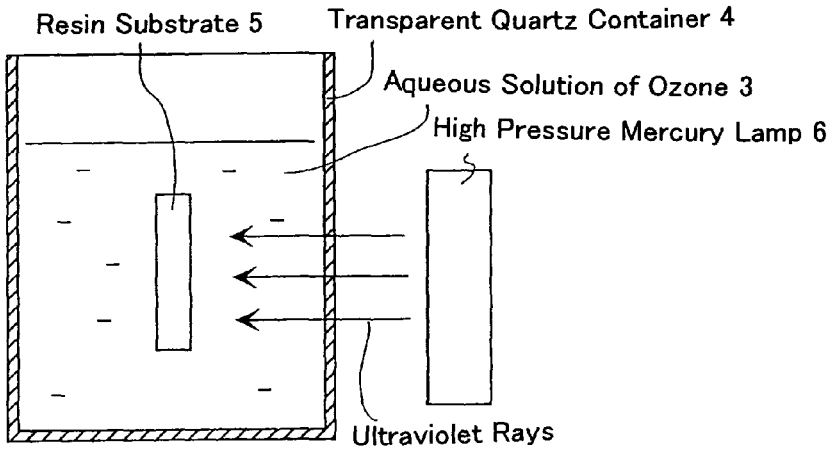
FIG. 2 is an explanation diagram showing an ozone solution-ultraviolet irradiation treating process in a first embodiment.

As shown in FIG. 2, an aqueous solution of ozone 3, which contains ozone of 80 ppm, was put in a transparent quartz container 4, a resin substrate 5 composed of ABS was immersed in the aqueous solution of ozone, and the transparent quartz container 4 was irradiated with ultraviolet rays from a high pressure mercury lamp 6 of 1 kW, which was disposed outside the transparent quartz container 4. The irradiating time of ultraviolet rays was five levels of one minute, three minutes, five minutes, seven minutes, and ten minutes, and after irradiated for a predetermined time, the resin substrate 5 was taken from the transparent quartz container 4.

<Alkali Treating Process>

Next, a mixture aqueous solution in which NaOH was dissolved in the amount of 50 g/L, and sodium lauryl sulfate was dissolved in the amount of 1 g/L was heated to 60° C., and each resin substrate after the ozone solution-ultraviolet irradiation treating process was immersed in the heated mixture aqueous solution for 2 minutes, whereby an anionic surface active agent (sodium lauryl sulfate) was adsorbed on each resin substrate.

Each resin substrate adsorbing the surface active agent was drawn up and, after cleaned with water and dried, was immersed in a catalyst solution prepared by dissolving 0.1 weight % of palladium chloride and 5 weight % of tin chloride in an aqueous solution of 3N hydrochloric acid, and heating to 50° C., for 3 minutes, and then immersed in an aqueous solution of 1N hydrochloric acid for 3 minutes for activation of palladium. With this method, resin substrates, each adsorbing a catalyst, were obtained.

Then, the obtained resin substrates, each adsorbing a catalyst, were immersed in a Ni—P chemical plating bath, which was kept at 40° C., to deposit a Ni—P plated coating for 10 minutes. The thickness of the deposited Ni—P plated coating in each resin substrate is 0.5 μm. Then, a copper plating was deposited by a thickness of 100 μm on a surface of the Ni—P plated coating using a copper sulfate-based Cu electroplating bath.

After the plated coating was formed, each resin substrate was dried at 70° C. for two hours. Then, the obtained plated coating was cut to form cuts, each having a width of 1 cm and a depth which reaches each resin substrate, and the adhesive strength of the plated coating of each resin substrate was measured with a tension testor. The measurement results are shown in TABLE 1.

Embodiment 2

Figure 3:
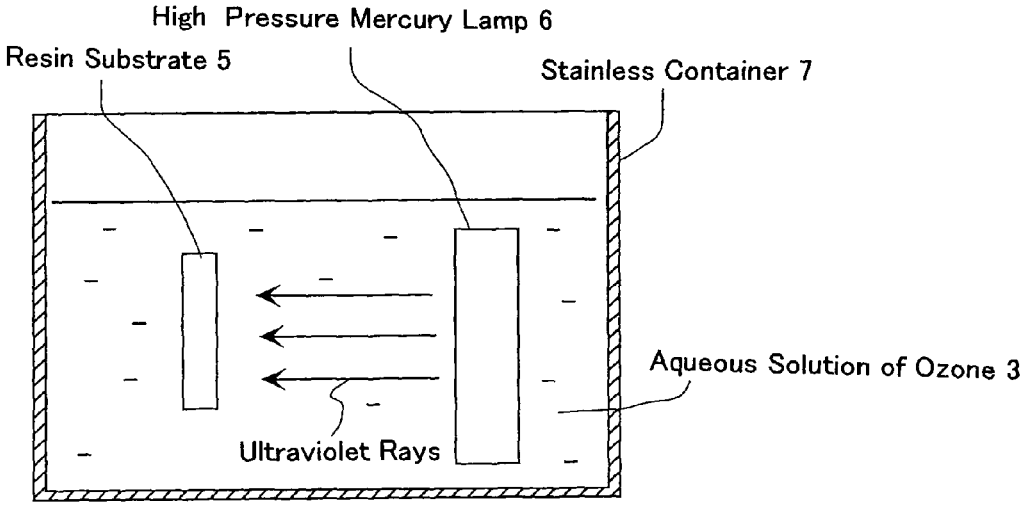
FIG. 3 is an explanation diagram showing an ozone solution-ultraviolet irradiation treating process in a second embodiment.

The ozone solution-ultraviolet irradiation treating process was carried out in a similar manner to Embodiment 1 except that, as shown in FIG. 3, an aqueous solution of ozone 3, which contains ozone of 80 ppm, was put in a stainless container 7, a resin substrate 5 composed of ABS and a high pressure mercury lamp 6 were immersed therein, and ultraviolet rays were irradiated against the resin substrate 5. Then, the alkali treating process, catalyst adsorbing process and electroplating process were carried out, similarly to Embodiment 1, to form a plated coating on each resin substrate, and the adhesive strength of the plated coating of each resin substrate was measured. The measurement results are shown in TABLE 1.

Embodiment 3

The ozone solution-ultraviolet irradiation treating process was carried out in a similar manner to Embodiment 1 except that the aqueous solution of ozone, which contains ozone of 80 ppm, was replaced with nitric acid containing ozone of 80 ppm. Then, the alkali treating process, catalyst adsorbing process and electroplating process were carried out, similarly to Embodiment 1 to form a plated coating, similarly to Embodiment 1, and the adhesive strength of the plated coating of each resin substrate was measured. The measurement results are shown in TABLE 1.

Embodiment 4

The ozone solution-ultraviolet irradiation treating process was carried out in a similar manner to Embodiment 1 except that the aqueous solution of ozone, which contains ozone of 80 ppm, was replaced with ethanol containing ozone of 80 ppm. Then, the alkali treating process, catalyst adsorbing process and electroplating process were carried out, similarly to Embodiment 1, to form a plated coating, similarly to Embodiment 1, and the adhesive strength of the plated coating of each resin substrate was measured. The measurement results are shown in TABLE 1.

Comparative Example 1

The ultraviolet irradiation treating process of irradiating only ultraviolet rays in the air was carried out by the method similar to that of Embodiment 1 except that resin substrates 5 composed of ABS were put in an empty transparent quartz container 4 containing no solution. Then, the alkali treating process, catalyst adsorbing process and electroplating process were carried out, similarly to Embodiment 1, to form a plated coating, similarly to embodiment 1. And the adhesive strength of the plated coating of each resin substrate 5 was measured. The measurement results are shown in TABLE 1.

Comparative Example 2

The ozone treating process of treating with only ozone solution was carried out by the method similar to that of Embodiment 1 except that the ultraviolet rays are not irradiated. Then, the alkali treating process, catalyst adsorbing process and electroplating process were carried out, similarly to Embodiment 1, to form a plated coating, similarly to embodiment 1 and the adhesive strength of the plated coating of each resin substrate was measured. And the measurement results are shown in TABLE 1.

<Evaluation>

TABLE 1

| | Ex. No. 1 | Ex. No. 2 | Ex. No. 3 | Ex. No. 4 | Comp. Ex. No. 1 | Comp. Ex. No. 2 |
|---|---|---|---|---|---|---|
| Ozone Treatment | Treatment | Treatment | Treatment | Treatment | No Treatment | Treatment |
| Ultraviolet rays treatment | Treatment | Treatment | Treatment | Treatment | Treatment | No Treatment |
| Solvent of the First Solution | Water | Water | Nitric Acid | Ethanol | — | Water |
| Treating Time | Adhesive Strength of the Plated Coating (kg/cm) | | | | | |
| 1 minute | No Adhesion | No Adhesion | 700 | 650 | No Adhesion | No Adhesion |
| 3 minutes | 600 | 630 | 1300 | 1250 | No Adhesion | No Adhesion |
| 5 minutes | 1100 | 1200 | 1450 | 1400 | 480 | 110 |
| 7 minutes | 1250 | 1330 | 1530 | 1500 | 1150 | 300 |
| 10 minutes | 1330 | 1450 | 1550 | 1530 | 850 | 600 |

It is clear that the methods of the embodiments of the present invention enable the formation of plated coatings having high adhesive strengths, as compared with Comparative examples 1 and 2, and it is clear that these results are due to the effect of the ozone treatment and the ultraviolet rays treatment. And, comparing the adhesive strengths of the plated coatings formed by treating for five minutes with each other, even the total of the adhesive strengths of Comparative examples 1 and 2 does not reach the adhesive strength of each embodiment, and it is clear from these results that the synergistic effect of the ozone treatment and the ultraviolet rays treatment is achieved.

And, it is also clear that, in Comparative example 1, the adhesive strength lowers due to a long ultraviolet irradiation, but in the embodiments, such defect is prevented.

Furthermore, it is clear that Embodiments 3 and 4 show higher adhesive strengths, as compared with that of Embodiment 1, and that the treating time can be shortened by the use of nitric acid or ethanol as a solvent for the ozone solution.

The invention claimed is:

1. A method for producing a member having a plated coating, comprising:

(a) irradiating a resin material with ultraviolet rays while said resin material is in contact with a first solution consisting of ozone in an organic or inorganic polar solvent other than water, and then (b) electroless plating said resin material, wherein the organic polar solvent is selected from the group consisting of methanol, isopropyl alcohol, N,N-dimethylformaldehyde, N,N-dimethylacetamide, dimethyl sulfoxide, N-methyl-pyrrolidon, hexamethylphosphoramide, formic acid, acetic acid, and mixtures thereof, wherein the inorganic polar solvent is nitric acid, and wherein the resin material irradiated by the ultraviolet rays while in contact with the first solution lacks a surface having prior roughening.

2. A method for producing a member having a plated coating as claimed in claim 1, further comprising bringing said resin material into contact with a second solution containing an alkaline component, between said ozone solution-ultraviolet irradiation treating process and said electroless plating process.

3. A method for producing a member having a plated coating as claimed in claim 2, wherein said second solution further contains at least one of an anionic surface active agent and a nonionic surface active agent.

4. A method for producing a member having a plated coating as claimed in claim 1, further comprising subjecting said resin material, after said electroless plating step, to electroplating.

5. A method for producing a member having a plated coating, comprising:

(a) irradiating a resin material with ultraviolet rays while said resin material is in contact with a first solution consisting of ozone in an organic or inorganic polar solvent other than water, and then (b) electroless plating said resin material, wherein the organic polar solvent is selected from the group consisting of N,N-dimethylformaldehyde, N,N-dimethylacetamide, dimethyl sulfoxide, N-methyl-pyrrolidon, hexamethylphosphoramide, formic acid, acetic acid, and mixtures thereof, wherein the inorganic polar solvent is nitric acid, and wherein the resin material irradiated by the ultraviolet rays while in contact with the first solution lacks a surface having prior roughening.

6. A pretreatment method for a resin material to be electrolessly plated, comprising:

irradiating said resin material with ultraviolent rays while said resin material is in contact with a first solution consisting of ozone in an organic or inorganic polar solvent other than water, wherein the organic polar solvent is selected from the group consisting of methanol, isopropyl alcohol, N,N-dimethylformaldehyde, N,N-dimethylacetamide, dimethyl sulfoxide, N-methyl-pyrrolidon, hexamethylphosphoramide, formic acid, acetic acid, and mixtures thereof, wherein the inorganic polar solvent is nitric acid, and wherein the resin material irradiated by the ultraviolet rays while in contact with the first solution lacks a surface having prior roughening.

7. A pretreatment method for a resin material to be electrolessly plated as claimed in claim 1, further comprising bringing said resin material, after said ozone solution-ultraviolet irradiation step, into contact with a second solution containing an alkaline component.

8. A pretreatment method for a resin material to be electrolessly plated as claimed in claim 7, wherein said second solution further contains at least one of an anionic surface active agent and a nonionic surface active agent.

9. A pretreatment method for a resin material to be electrolessly plated, comprising:

irradiating said resin material with ultraviolent rays while said resin material is in contact with a first solution consisting of ozone in an organic or inorganic polar solvent other than water, wherein the organic polar solvent is selected from the group consisting of N,N-dimethylformaldehyde, N,N-dimethylacetamide, dimethyl sulfoxide, N-methyl-pyrrolidon, hexamethylphosphoramide, formic acid, acetic acid, and mixtures thereof, wherein the inorganic polar solvent is nitric acid, and wherein the resin material irradiated by the ultraviolet rays while in contact with the first solution lacks a surface having prior roughening.

* * * * *